US005117261A

United States Patent [19]

Sakai et al.

[11] Patent Number: 5,117,261

[45] Date of Patent: May 26, 1992

[54] IMAGE FORMING APPARATUS WITH JAM RECOVERY FUNCTION

[75] Inventors: Toshiyuki Sakai; Masaru Imaizumi; Hideya Nishise; Katsuhiko Takeda; Hideo Kitakubo, all of Osaka, Japan

[73] Assignee: Minolta Camera Kabushiki Kaisha, Osaka, Japan

[21] Appl. No.: 336,255

[22] Filed: Apr. 11, 1989

[30] Foreign Application Priority Data

Apr. 21, 1988 [JP] Japan ..... 63-98810

[51] Int. Cl.[5] ..... G03G 21/00

[52] U.S. Cl. ..... 355/207; 355/272; 355/327

[58] Field of Search ..... 355/207, 272, 205, 275, 355/206, 316, 309, 326, 327, 308; 271/258

[56] References Cited

U.S. PATENT DOCUMENTS

| | | | |
|---|---|---|---|
| 4,260,236 | 4/1981 | Tsuda et al. | 355/308 X |
| 4,260,904 | 4/1981 | Horie et al. | 355/206 X |
| 4,352,549 | 10/1982 | Ozawa | 355/272 |
| 4,627,711 | 12/1986 | Schron | 355/316 X |
| 4,711,555 | 12/1987 | Toshimitsu et al. | 355/299 |
| 4,733,281 | 3/1988 | Yoshinaga et al. | 355/309 X |
| 4,750,020 | 6/1988 | Ishizu et al. | 355/205 |

FOREIGN PATENT DOCUMENTS

| | | | |
|---|---|---|---|
| 0057260 | 4/1984 | Japan | 355/206 |
| 60-33575 | 2/1985 | Japan . | |
| 0100151 | 6/1985 | Japan . | |
| 0206567 | 9/1987 | Japan | 355/275 |

*Primary Examiner*—A. T. Grimley
*Assistant Examiner*—Robert Beatty
*Attorney, Agent, or Firm*—Willian Brinks Olds Hofer Gilson & Lione

[57] ABSTRACT

An image forming apparatus using the electrophotographic process in which a toner image on a photoconductive drum is transferred onto a secondary transferring belt and the transferred toner image is further transferred onto a copy paper provides a sensor for detecting an occurrence of a paper jam before the copy paper reaches the secondary transferring belt and resumes the copying operation from the action suspended by the paper jam as soon as it is recovered from the paper jam.

6 Claims, 9 Drawing Sheets

IMAGE FORMING APPARATUS WITH JAM RECOVERY FUNCTION

BACKGROUND OF THE INVENTION

1. Field of the Invention

The present invention relates to an image forming apparatus wherein a toner image formed on a photoconductive body is first transferred onto an intermediate transferring body (primary transfer) and, then, the transferred toner image is transferred onto a copy paper (secondary transfer) to obtain a hard copy.

2. DESCRIPTION OF THE PRIOR ART

Recently, such a copy machine as mentioned above (hereinafter referred to as a copy machine of secondary transfer type) is on the market. This type of copying machine is used for a full color copying machine as an example. In the full color copying machine of secondary transfer type, for instance, an electrostatic latent image formed on the photoconductive body by passing a reflected light through a blue color filter is developed with yellow toner and the developed image is transferred onto an intermediate transferring body at first. Next, an electrostatic latent image formed using a green color filter is developed with magenta toner and the developed image is transferred onto the intermediate transferring body to superimpose the same on the image developed with yellow toner and, thereafter, an electrostatic latent image formed using a red color filter is developed with cyan toner and the developed cyan toner image is superimposed on the yellow and magenta toner images by transferring the same onto the transferring body. The full color image thus formed by superimposing three toner images on the transferring body is transferred on a copy paper secondarily to give a full color copy.

Usually, an endless belt of a flexible dielectric film such as polyimido film is used for the intermediate transferring body.

In the image forming apparatus such as the full color copying machine, troubles such as paper jams are often caused on the way of conveying copy papers.

Conventionally, when such a trouble is caused, copy actions having been performed until then are automatically canceled and a series of copy actions including a document scan—formation of a latent image on a photoconductive body—a development with toner—transfer of the image onto an intermediate transferring body—copy paper feeding—transfer of toner image onto a copy paper—fixing and discharge of the copy paper has to be repeated from the beginning after removing the copy paper which had been jammed.

However, assuming such a case that a paper jam is caused on the way of the path for transporting copy papers to the secondary transferring station, the secondary toner image to be transferred onto a copy paper is maintained on the intermediate transferring body without any damage due to the paper jam since it is caused before reaching the secondary transferring station. In other words, the secondary toner image is kept in a transferable state nevertheless.

Accordingly, it is wasteful with respect to toner, time, electric power and the like to repeat the series of copy actions from the beginning in such a case as mentioned above.

SUMMARY OF THE INVENTION

An essential object of the present invention is to provide an image forming apparatus which is able to start copy actions from a stage in which a trouble such as a paper jam has been caused as soon as it is recovered from the trouble.

Another object of the present invention is to provide an image forming apparatus with jam recovery function which is suitable for obtaining full color copies.

In order to accomplish these objects, according to the present invention, there is provided an image forming apparatus comprising: a photoconductive member; an electrostatic latent image forming means for forming an electrostatic latent image on said photoconductive member according to an original; a developing means for developing the electrostatic latent image with toner to thereby form a toner image on said photoconductive member; a toner image retaining member; a first transfer means for transferring the toner image on said photoconductive member onto said toner image retaining member; a second transfer means for transferring the toner image on said toner image retaining member onto a paper at a transfer position; a paper transport means for transporting the paper to the transfer position; a jam detection means for detecting an occurrence of a paper jam before the paper reaches the transfer position; and a jam recovery means for activating said paper transport means and said second transfer means immediately when the image forming apparatus is recovered from the paper jam detected by said jam detection means.

According to the present invention, if a paper jam is caused on the way of the paper transport path for transporting a copy paper to the secondary transferring station, the image forming apparatus is started to feed a copy paper to the secondary transferring station and to transfer a secondary toner image secondarily without canceling copy actions having been done until then, as soon as the apparatus is recovered from the trouble.

The present invention is desirably applied to a color image forming apparatus wherein primary transfer operation is repeated to obtain a full color toner image.

According to the present invention, waste of time and electric power can be avoided in the case that a paper jam is caused on the way of the paper transport path and, also, a time necessary to obtain a copy is shortened in that case.

BRIEF DESCRIPTION OF DRAWINGS

These and other objects and features of the present invention will become more apparent when the preferred embodiment of the present invention is described in detail with reference of accompanied drawings in that.

DETAILED DESCRIPTION OF THE PREFERRED EMBODIMENT

Composition of Copying Machine

Figure 1:
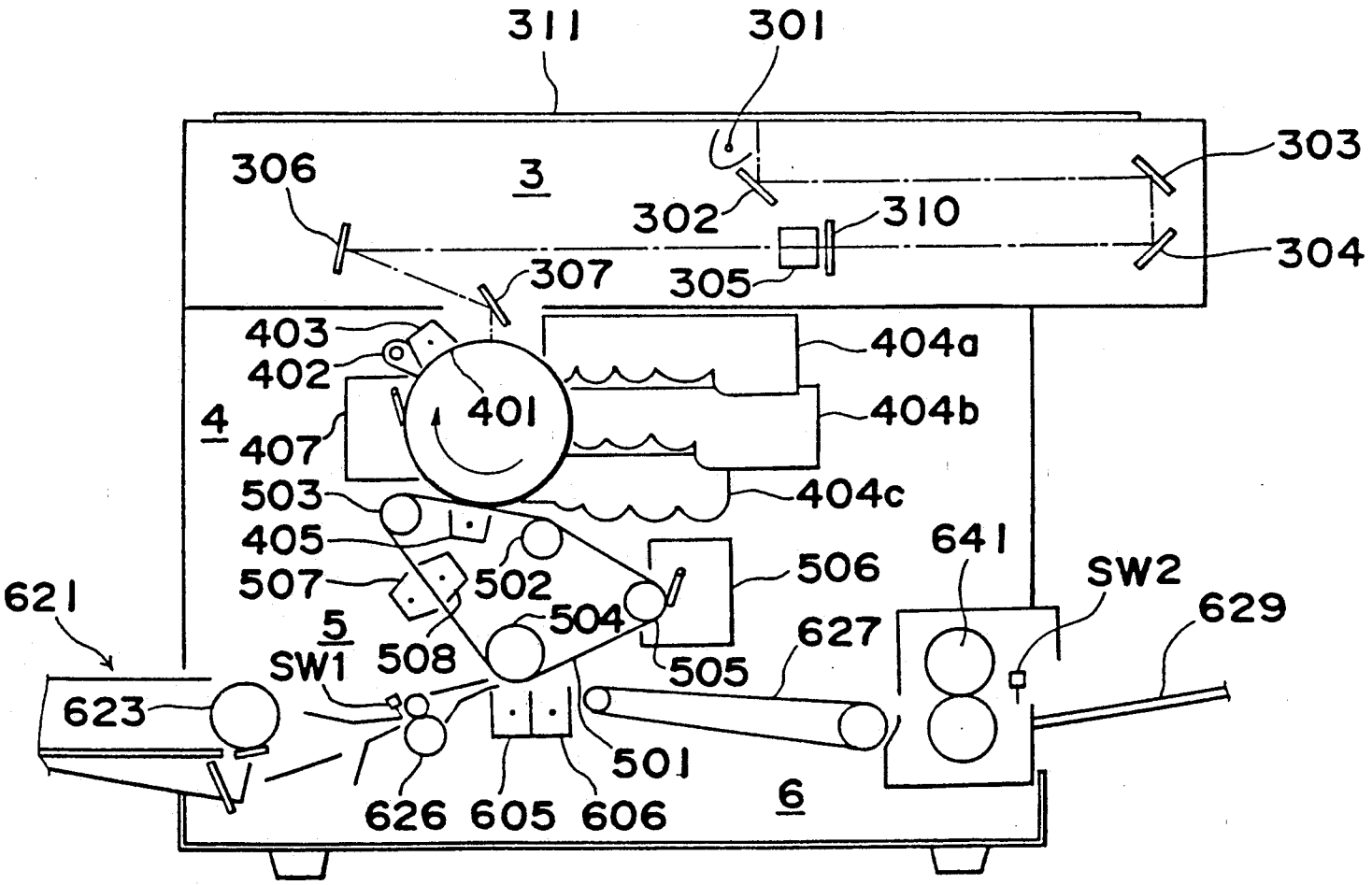
FIG. 1 is a schematical sectional view to a copying machine to which the present invention is applied.

FIG. 1 shows a schematic cross-section of the copying machine according to the preferred embodiment of the present invention.

The copying machine comprises a scanning optical system 3, an image visualizing section 4, an intermediate image forming section 5 and a paper transporting section 6.

[1] Scanning optical system 3

The optical system 3 is provided for optically scanning a document put on a document platen 311 and transmitting the image reflected from the document to a photoconductive drum 401 provided in the image visualizing section 4.

This optical system 3 is comprised of an exposure lamp 301 for illuminating the document, first to fifth mirrors 302, 303, 304, 306 and 307 for guiding the reflected light image reflected from the document so as to project it on the photoconductive drum 4, an RGB filter 310 for dissolving the reflected light image into the three primary color components and a lens block 305 for focusing the reflected image on the photoconductive drum 401 and varying the magnification of copy.

The exposure lamp 301 and the first mirror 302 are mounted on a first scanner (not shown) and reciprocally moved to scan a document put on the document platen 311 optically. Also, the second and third mirrors 303 and 304 are mounted on a second scanner (not shown) and reciprocally moved at a velocity of one half of the velocity of the first scanner. The first and second scanners are driven by a driving mechanism with a scanning motor (not shown).

The lens block 305 is moved in a direction of the optical axis thereof by a motor (not shown) upon varying the magnification. The fourth mirror 306 is used for inverting the document image and the fifth mirror 307 is used for adjusting the focusing position on the photoconductive drum 401.

Figure 2:
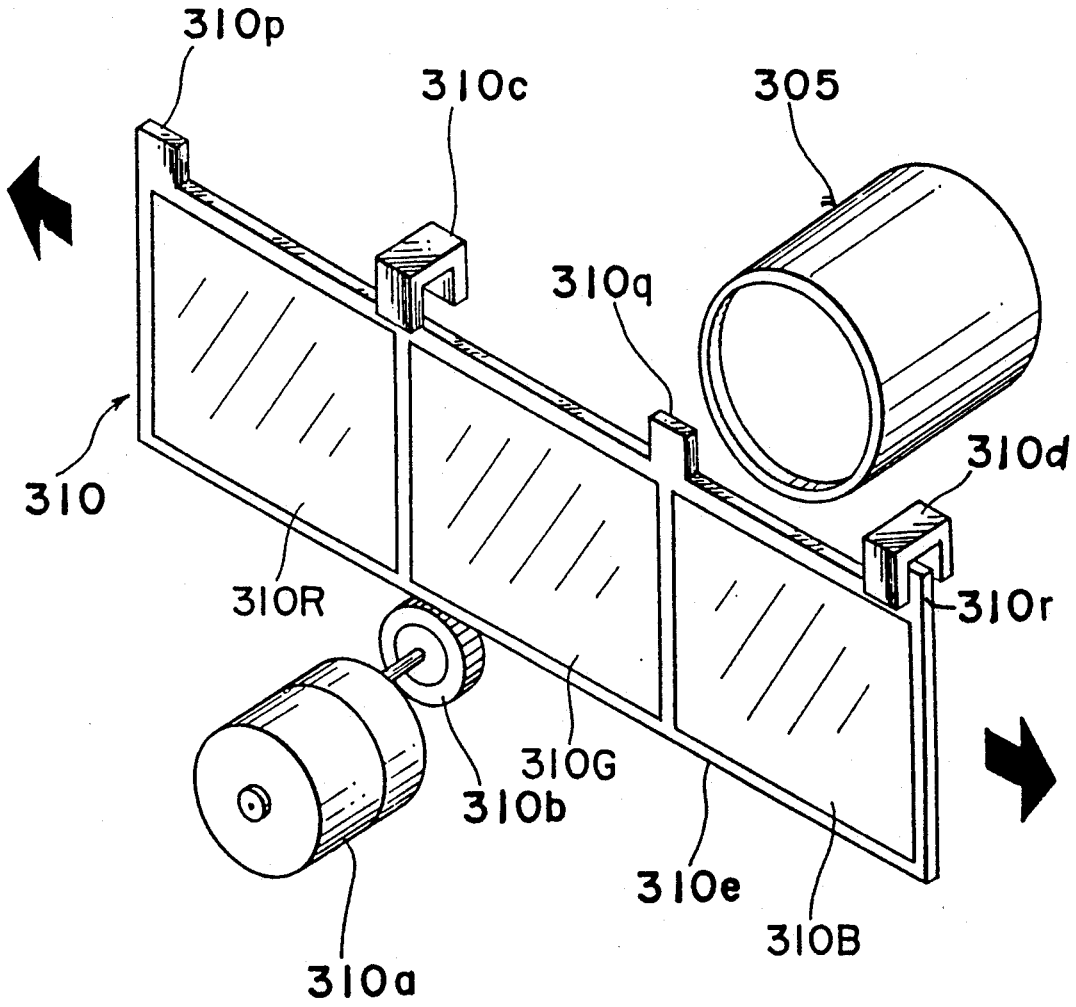
FIG. 2 is a perspective view of a mechanism for an RGB filter provided in the copying machine.

As shown in FIG. 2, the RGB filter 310 provides an R (red) filter 310R, a G (green) filter 310G and a B (blue) filter 310B arranged along a horizontal line. These three primary colors R, G and B are complemental to cyan, magenta and yellow toner colors, respectively. A frame 310*e* of the filter 310 for holding respective R, G, B filters 310R, 310G and 310B has a ruck (not shown) formed along the under surface thereof and the ruck is engaged to a gear 310*b* fixed to a driving shaft of a motor 310*a*. Accordingly, the frame 310*e* is moved in either of directions indicated by arrows in accordance with the direction of rotation of the gear 310*b* so as for each center of three filters to coincide with the optical axis of the focusing lens block 305. In order to position respective filters, two photocouplers 310*c* and 310*d* are arranged along the upper line of the frame 310*e* on which three protrusions 310*p*, 310*q* and 310*r* are formed at distances suitable for positioning respective filters 310R, 310G and 310B. Namely, the motor 310*a* is controlled in accordance with the combination of two signals from two photocouplers 310*c* and 310*d*.

[II] Visualizing section 4

The visualizing section 4 is comprised of a mechanism for forming an electrostatic latent image on the surface of the photoconductive drum 401 according to the image transmitted by the optical system 3, for visualizing the latent image by developing the same with toner and for transferring the visualized toner image onto an intermediate transferring belt 501 primarily. When the full color copy mode is designated, the visualizing process including the latent image formation, the development by toner and the primary transfer onto the intermediate transferring belt 501 is repeated three times selecting the filter in the order of B, G and R and the toner in the order of Y, M and C, respectively. Accordingly, in the full color copy mode, an intermediate image of full color which is superimposed with three toner images of cyan, magenta and yellow is formed on the intermediate transferring belt 501.

Referring to FIG. 1, the visualizing section 4 is comprised of a photoconductive drum 401 supported rotatably abut the axis thereof and in a direction indicated by an arrow, an eraser lamp 402, an electrifying charger 403, three developing unit 404*a*, 404*b* and 404*c* wherein yellow toner, magnet toner and cyan toner are contained, respectively, a primary transferring charger 405 and a cleaner 407.

According to the rotation of the photoconductive drum 401 in the direction indicated by the arrow, charge thereon is erased by the eraser lamp 402 and, then, it is electrified uniformly by the electrifying charger 403. Next, a latent image is formed on the surface of the drum 401 corresponding to the document image transmitted by the optical system 3. The latent image is visualized by either one of three developing units 404*a*, 404*b* and 404*c*. The toner image is transferred onto the intermediate transferring belt 501 primarily. As is apparent to those skilled in the art, the intermediate transferring belt 501 is driven in synchronization with the rotation of the photoconductive drum 401.

The transferring charger 405 exerts an electric absorbing force to the toner image on the photoconductive drum 401 to transfer the same onto the intermediate transferring belt 501.

After the primary transfer, tone remaining on the drum 401 is removed by the cleaner 407 for the next visualizing and transferring process.

[III] Intermediate image forming section 5

The intermediate image forming section 5 is provided for holding the toner image transferred from the photoconductive drum 401 and for transferring the toner image onto a copy paper secondarily.

Figure 3:
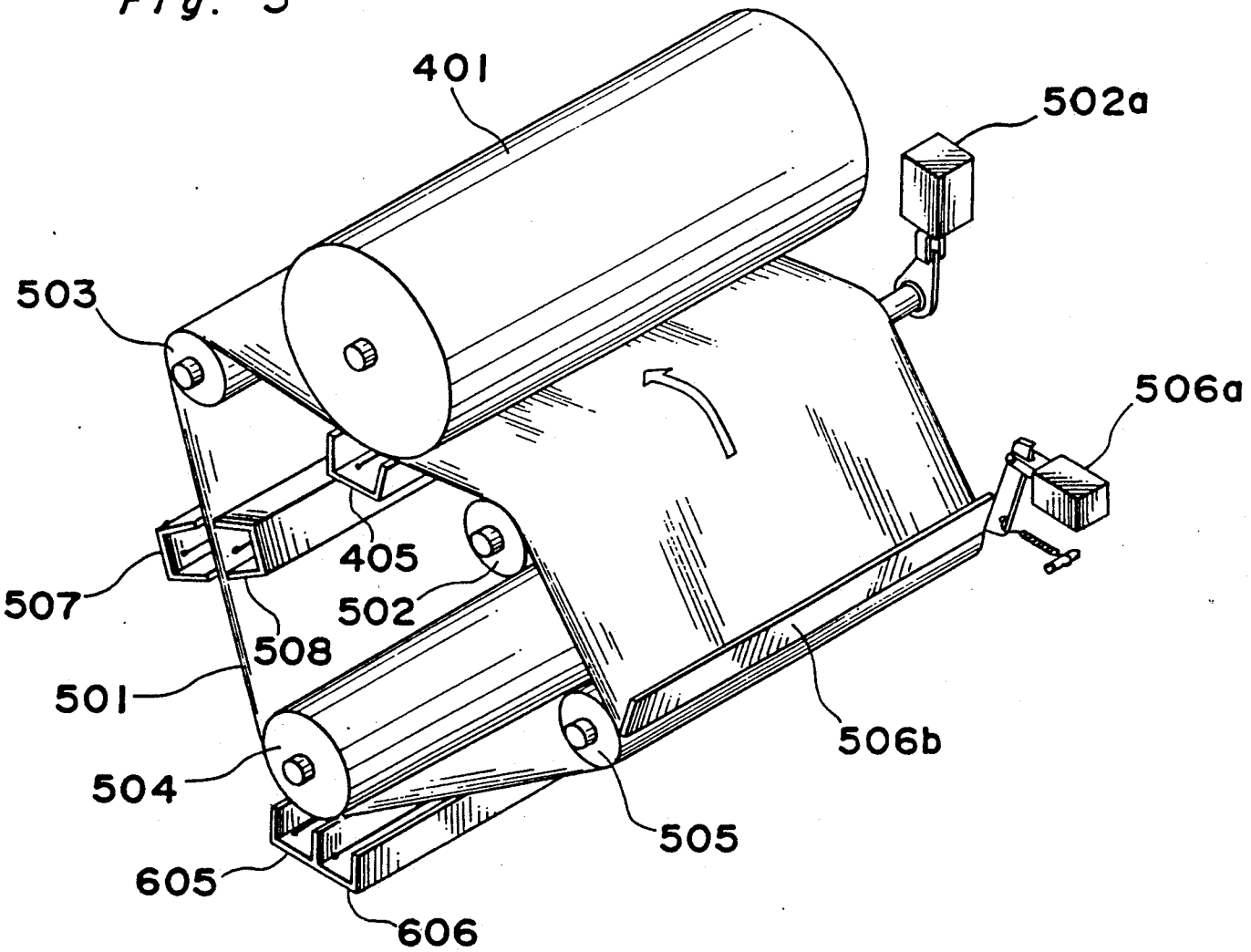
FIG. 3 is a perspective view showing a mechanism for forming a secondary image provided in the copying machine.

Referring to FIGS. 1 and 3, the intermediate image forming section 5 is comprised of an intermediate transferring belt 501, four supporting rollers 502 to 505 for running the endless transferring belt 501 so as to drive the same while contacting it to the drum 401 at a position above the transferring charger 405, a pair of chargers 507 and 508 for unifying an electrifying voltage of the toner image before the secondary transfer onto a copy paper, a secondary transferring charger 605 for transferring the toner image on the intermediate transferring belt 501 onto a copy paper by exerting an electric absorbing force thereto and a cleaner 506 for removing toner remaining on the belt 501 after the secondary transfer.

Upon transferring the toner image from the photoconductive drum 401 to the intermediate transferring belt 501, an actuator 502*a* is activated so as to pull up the supporting roller 502 and, as a result, the belt 501 is pressed to the surface of the drum 401 to enable the secondary transfer of the toner image.

On the contrary, when the secondary transfer is completed, an actuator 506*a* is activated to contact a belt cleaning blade 506*b* to the intermediate transferring belt 501. Thus, toner remaining on the belt 501 is removed.

[IV] Paper transporting section

The paper transporting section 6 is a mechanism for feeding a copy paper between the secondary transferring charger 605 and the intermediate transferring belt 501 in the secondary transferring section 5 at a predetermined timing in synchronization with the rotation of the belt 501 for sending the copy paper on which the toner image is transferred to a fixing device 641 and for discharging the same outside the copying machine.

Referring to FIG. 1, the paper transporting section 6 is comprised of a cassette 621 for containing copy papers therein, a paper feeding roller 623 for picking up copy papers one by one, a pair of timing rollers 626 for feeding a copy paper between the intermediate transferring belt 501 and the secondary transferring charger 605 at a predetermined timing, a separating charger 606 for separating the copy paper from the belt 501, a conveyer belt 627, a fixing device 641 for fixing the transferred toner image on the separated copy paper by heating the same and a tray 629 for containing copy papers discharged outside the copying machine.

Also, a switch SW1 is arranged near the pair of timing rollers 626 to detect a copy paper to be fed toward the intermediate transferring belt 501 and, further, another switch SW2 is arranged outside the fixing device 641 to detect the copy paper being discharged.

Composition of the control circuit

Figure 4:
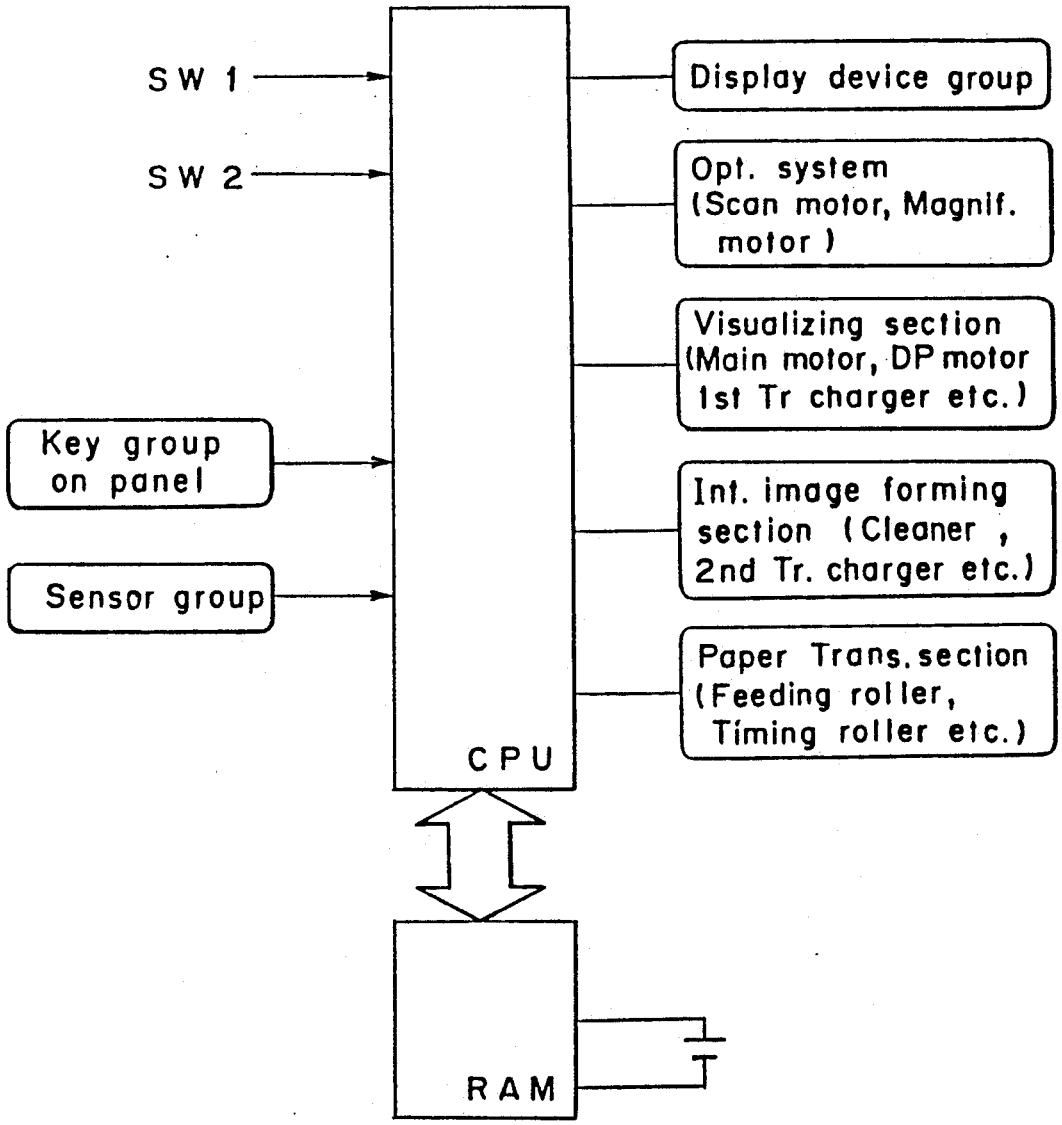
FIG. 4 is a block diagram for showing input and output relation regarding a processor provided in the copying machine.

FIG. 4 is a block diagram of the control circuit to the copying machine according to the preferred embodiment of the present invention.

As shown therein, the control circuit is comprised of a central processor unit CPU and a random access memory RAM backed up by a battery.

Various signals such as signals from the switches SW1 and SW2, signals from respective key switches arranged on an operation panel (not shown) of the copying machine, signals from respective sensors arranged at various positions in the copying machine for detecting actions of parts arranged therein are inputted to the CPU.

Also, the CPU outputs control signals for controlling the scan operation of the optical system 3, control signals for controlling the image visualizing section 4, control signals for controlling the intermediate image forming section 5 and control signals for controlling the power transporting section 6 at respective predetermined timings.

In the RAM backed up by the battery, for example, a state of Jal flag is stored and held even when the power supply is switched off. The Jal flag which is set at one when a paper jam is caused before starting the secondary transfer.

Actions of the copying machine

Actions of the copying machine according to the preferred embodiment of the present invention will be explained hereinafter referring to flow charts shown in FIGS. 5, 6, 7, 8 and 9.

[I] Main routine

Figure 5:
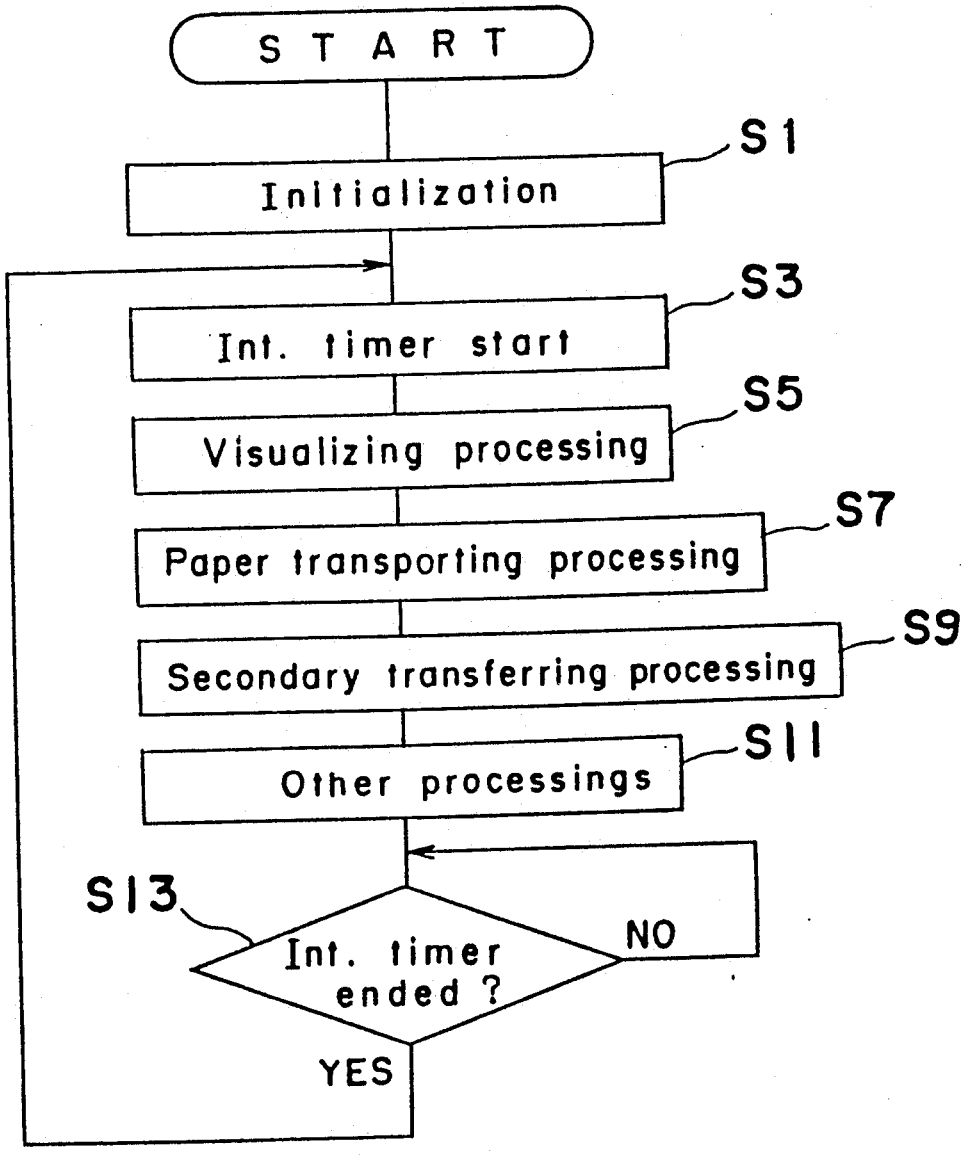
FIG. 5 is a flow chart of the main routine to be executed by the processor.

FIG. 5 shows a flow chart of the main routine to be executed by the CPU.

When the main routine is started by switching on the main switch of the machine, the CPU is initialized at first at step S1. For example, an internal counter n1 which will be explained later is reset. However, values of the Jal flag and an internal counter n2 are read out of the RAM and they are set at respective values read out.

At step S3, an internal timer for regulating a time interval of one routine is started.

Thereafter, a subroutine S5 for the visualizing processing, a subroutine S7 for transporting a copy paper and a subroutine S9 for the secondary transferring processing are called successively and, at step S11, other processings are executed.

Details of each subroutine will be explained later.

Other processings to be executed at step 11 include processings such as processings for accessing signals from key switches of the operation panel which are not executed at respective steps S5, S7 and S9 but are to be executed by the CPU.

In one of other processings to be executed at step S11, a visualization flag is set if predetermined conditions are satisfied. The predetermined conditions are defined as setting conditions for executing the visualizing action such as input of the copy start key, completion of setting the RGB filter at a predetermined position and the like.

Thereafter, when the internal timer set at step S3 times up, one routine is completed at step S13 in order to start the next routine from step S3.

[II] Visualizing subroutine

Figure 6:
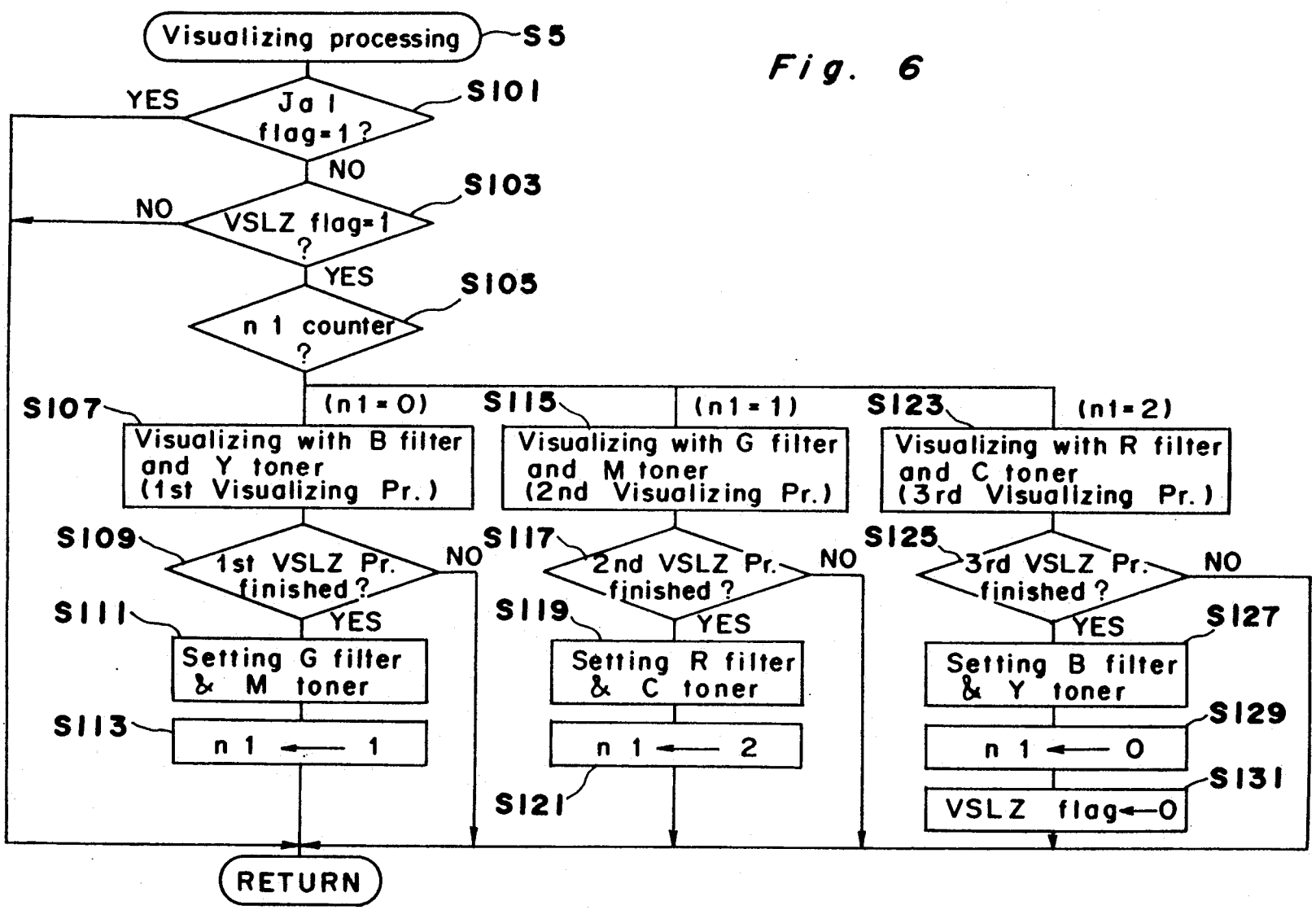
FIG. 6 is a flow chart of the subroutine for visualizing process shown in FIG. 5.

FIG. 6 shows a flow chart of the visualizing subroutine (S5).

This subroutine is executed only in the case that the Jal flag has been reset at zero (NO at step S101) and the visualization flag has been set (YES at step S103). The Jal flag is set when a paper jam is caused before starting the secondary image transfer (See step S223 of FIG. 7) and is reset when the discharge of the copy is completed (See step S259 of FIG. 8). The visualization flag is set when the preparation for executing the visualizing action is completed (See step S11 of FIG. 5) and is reset when the final developing process is completed (See step S131 of FIG. 6).

When this subroutine is started, the state of Jal flag is checked at step S101.

If it is set (YES at step S101), the process returns to the main routine at once. Namely, this indicates that a paper jam has been caused before starting the secondary image transfer and, therefore, the paper feeding and the secondary image transfer should be done just after the copying machine is recovered from the paper jam.

On the contrary, if the Jal flag is not set (NO at step S101), the process advances to step S103 in order to check the visualization flag. If it is not set (NO at step S103), the process returns to the main routine in order to wait for the completion of the preparation for executing the visualizing process since this indicates that conditions for starting the visualizing process are not satisfied.

If the visualization flag is set (YES at step S103), the process advances to step S105 to decide the value of the counter n1. This counter n1 is a counter for regulating the filter and the developing unit to be selected at this time in order to execute the visualizing process.

If n1 is equal to zero, the process advances to step S107 in order to execute the first visualizing process using B filter 310B and Y (yellow) toner at predetermined timings. The visualizing process includes a process for executing a series of visualizing actions such as document scan, electrostatic latent image formation, toner development and the primary image transfer and processings accompanied with the above visualizing actions.

When the first visualizing processing is completed (YES at step S109), G filter 310G and the developing unit 404*b* containing magenta toner therein are selectively set at step S111. Thereafter, the counter n1 is incremented by one at step S113 in order to prepare the second visualizing processing. The second visualizing processing is a visualizing processing using G filter 310G and the developing unit 404*b* containing magenta toner therein (See step S115).

When the second visualizing processing is completed at step S117 in the next routine, the process advances to step S119 and R filter 310R and the developing unit 404*c* containing cyan toner therein are selectively set thereat. And, the counter n1 is incremented by one (n1←2) in order to prepare the third visualizing processing.

In the next routine, the process advances to step S123 to execute the third visualizing processing since the counter n1 is set at two. During the third visualizing processing, a secondary transfer start (STS) flag and a paper feeding (PF) flag are set under predetermined conditions, respectively. The STS flag is a flag for indicating that the preparation for starting the secondary image transferring action has been completed and the paper feeding (PF) flag is a flag for indicating that the preparation for starting the paper feeding action has been completed.

These flags can be set at a timing when the time comes to a time preceding to an expected finishing time of the third visualizing processing by a predetermined time interval.

When the third visualizing processing has been completed (YES at step S125), the process advances to step S127 in order to set B filter 310B and the developing unit 404*a* containing yellow toner for the next visualizing processing. Further, at step S129, the counter n1 is reset at zero and the visualization flag is reset at step S131.

[III] Paper transporting subroutine

Figure 7:
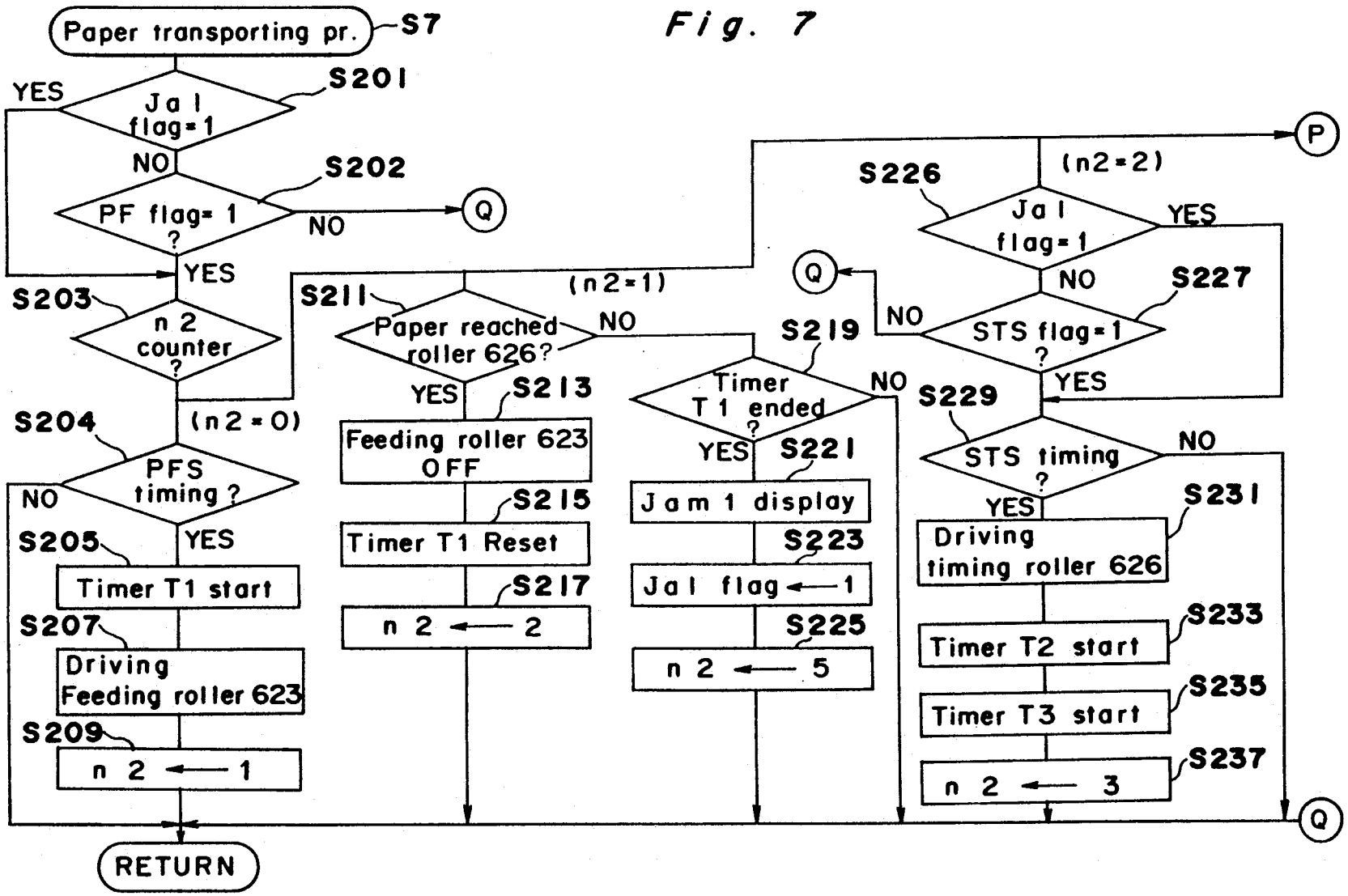
FIGS. 7 and 8 are flow charts of the subroutine for a paper feeding processing shown in FIG. 5.
Figure 8:
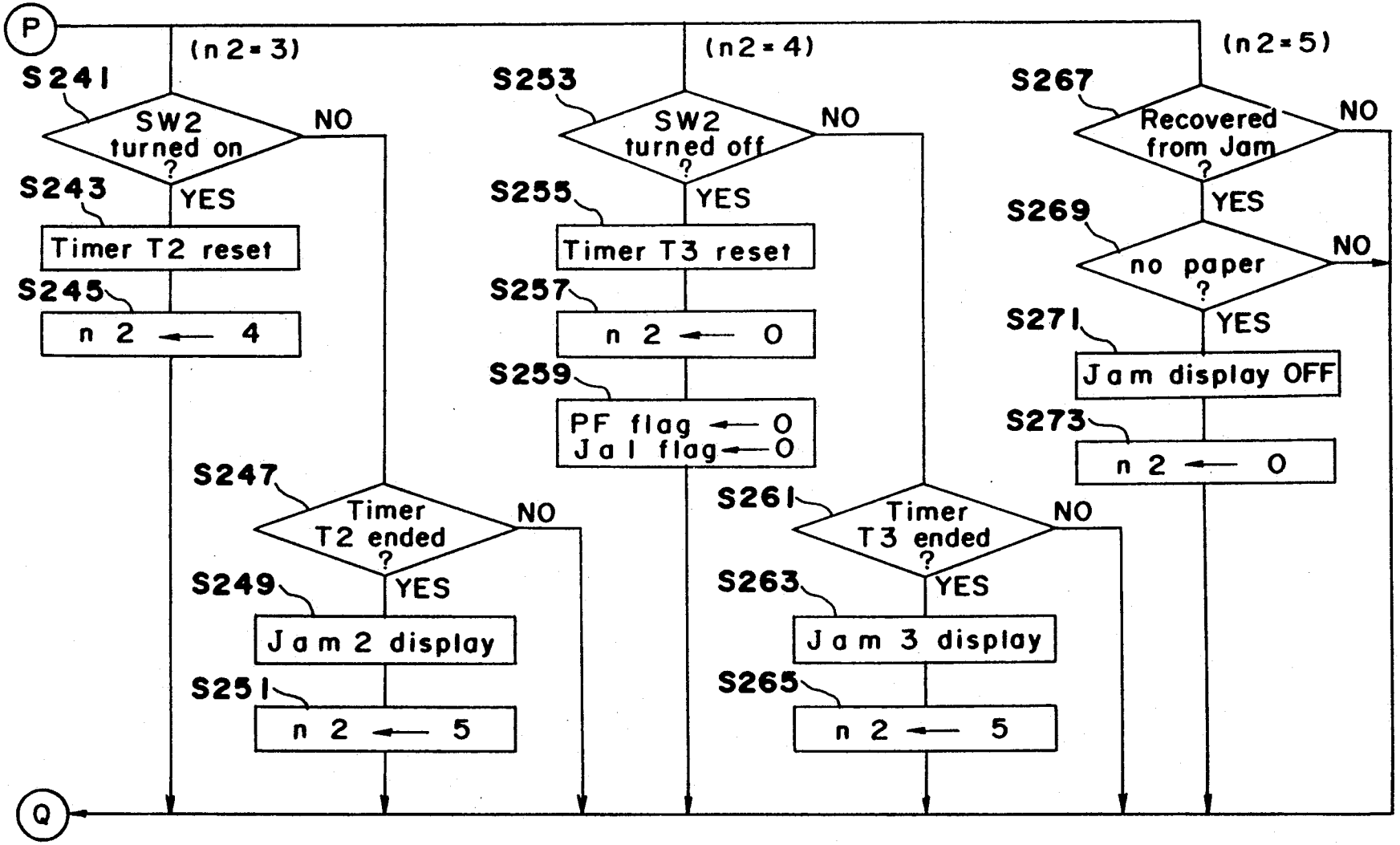

FIGS. 7 and 8 show a flow chart for the paper transporting subroutine S7 of the main routine.

This subroutine is executed when the Jal flag has been set (YES at step S201) or when the paper feeding flag has been set (YES at step S203). The paper feeding flag is set at a timing relating to a finishing time of the primary image transfer using three color toners and is reset when the discharge of a copy paper has been completed.

When the subroutine is started, the state of the Jal flag is checked at step S201. If the Jal flag has been set (YES at step S201), the process advances to step S203 jumping step S202 in order to execute the paper transporting action. Namely, since it indicates that the paper jam is caused before starting the secondary image transfer and, therefore, the intermediate image on the intermediate transferring belt 501 is not damaged, the paper feeding action and the secondary image transferring action should be executed just after the recovery from the paper jam. If the Jal flag is not set (NO at step S201), the process advances to step S202 in order to check the paper feeding flag.

If the paper feeding flag is not set (NO at step S202), the process returns to the main routine since the condition for starting the paper feeding action has not been satisfied yet.

On the other hand, if the paper feeding flag is set (YES at step S202), the process advances to step S203 to execute the paper transporting action.

At step S203, the counter n2 is checked. This counter n2 is provided for regulating timings necessary for the paper transporting action.

The process branches off in accordance with the value of the counter n2.

[i] n2=0 (Start of the paper feeding)

If it is decided that the value of the counter n2 is zero at step S203, after waiting a timing for starting the paper feeding action (YES at step S204), a timer $T_1$ is started at step S205. This timer $T_1$ is a timer for detecting a jam caused before starting the secondary image transfer and the time interval of the timer $T_1$ is set at a value needed for a copy paper to travel from the paper feeding roller 623 to the timing roller 626. Meanwhile, the paper feeding timing is given by an input of a copy start key (not shown) in the case of Jal flag=1 or by a completion timing of the first image transfer in the case of the paper feeding flag=1.

After starting the timer $T_1$, the paper feeding roller 623 is driven to start the paper feeding action at step S207 and, further, at step S209, the counter n2 is incremented at one.

[ii] n2=1

If n2=1, the process advances to step S211. At step S211, it is decided according to the signal from the switch SW1 whether or not the copy paper fed by the feeding roller 623 reaches the timing roller 626.

If the timer $T_1$ is ended before the copy paper reaches the timing roller 626 (YES at step S219), since it indicates a paper jam caused between the feeding roller 623 and the timing roller 626, "Jam 1" is displayed on a display panel (not shown) at step S221 and the Jal flag is set at step S223. Further, at step S225, the value of the counter n2 is set at five to make ready for the processing to be executed after the recovery from the paper jam. Values of the Jal flag (Ja=1) and the counter n2 (n2=5) are stored into the RAM in order to hold them even when the main power switch is switched off.

On the other hand, if the copy paper reaches the timing roller 626 before the timer $T_1$ ends (YES at step S211), the paper feeding roller 623 is switched off at step S213 and the timer $T_1$ is reset at step S215. Further, the counter n2 is set at two for making ready for the next paper feeding at step S217.

[iii] n2=2 (Secondary transfer)

If n2=2, the process advances to step S226 to start the secondary transferring action.

If the Jal flag is set (YES at step S226) or if a secondary transfer starting (STS) flag is set (YES at step S227), the process advances to step S229 to wait for a signal which gives a timing for starting the secondary transferring action. The signal is generated, for example, at a timing when the leading end of the toner image on the intermediate transferring belt 501 reaches the predetermined position.

When the timing for starting the secondary transferring action is given by the signal (YES at step S229), the timing roller 626 is driven to feed the copy paper between the secondary transferring charger 505 and the intermediate transferring belt 501 at step S231. Then timers $T_2$ and $T_3$ are started at steps S233 and S235, respectively and the value of the counter n2 is set at three at step S237. The timer $T_2$ is set to have a time interval needed for the leading end of the copy paper to reach the exit of the fixing device 641 and the timer $T_3$ is set to have a time interval needed for the trailing end of the copy paper to reach the exit of the fixing device 641.

[iv] n2=3 (Secondary transfer to fixing)

If it is decided at step S203 that the value of the counter n2 is equal to three, the process proceeds to step S241.

Steps from S241 to S251 shown in FIG. 8 are steps for detecting whether or not a paper jam is caused before the leading end of the copy paper reaches the exit of the fixing device 641 after the secondary image transfer.

Namely, if the timer $T_2$ ends (YES at step S247) before the leading end of the copy paper reaches to the exit of the fixing device, this indicates that a paper jam is caused on the way from the secondary transferring section to the exit of the fixing device. Accordingly, "Jam 2" is displayed on the display panel at step S249 and the value of the counter n2 is set at five at step S251 for executing necessary processings to be done after the recovery from the paper jam.

On the other hand, if the leading head of the copy paper reaches the exit of the fixing device before the timer $T_2$ ends and, therefore, the switch SW2 is switched on (YES at step S241), the timer $T_2$ is reset at step S243 since no paper jam is caused between the secondary transferring section and the exit of the fixing device. Further, the value of the counter n2 is set at four at step S245 for the next routine.

[v] n2=4 (Fixing device)

If n2=4, the process advances to step S253. Steps from S253 to S265 are provided for detecting a paper jam caused in the fixing device 641.

Namely, if the timer $T_3$ ends before the switch SW2 is switched off at a timing when the trailing end of the copy paper passes thereby, this indicates that a paper jam is caused in the fixing device and, accordingly, "Jam 3" is displayed on the display panel at step S263. Further, the value of the counter n2 is set at five at step S265 for the next processing after recovery from the paper jam.

On the other hand, if the switch SW2 is switched off by the pass of the trailing end of the copy paper before the timer $T_3$ ends (YES at S253), the timer $T_3$ is reset at step S255 since no paper jam is detected. And, the value of the counter n2 is reset at zero at step S257 for starting the next paper feeding processing.

[vi] n2=5 (Jam reset)

If n2=5, the process advances to step S267. Steps from step S267 to S273 are provided for the processings to be done after the recovery from the paper jam.

Namely, after the recovery from the paper jam and provided that no copy paper is remaining in the copy machine (YES at step S269), "Jam display" is turned off at step S271 and the value of the counter n2 is reset at zero at step S273 for starting the next paper feeding action.

[iv] Secondary transferring processing

Figure 9:
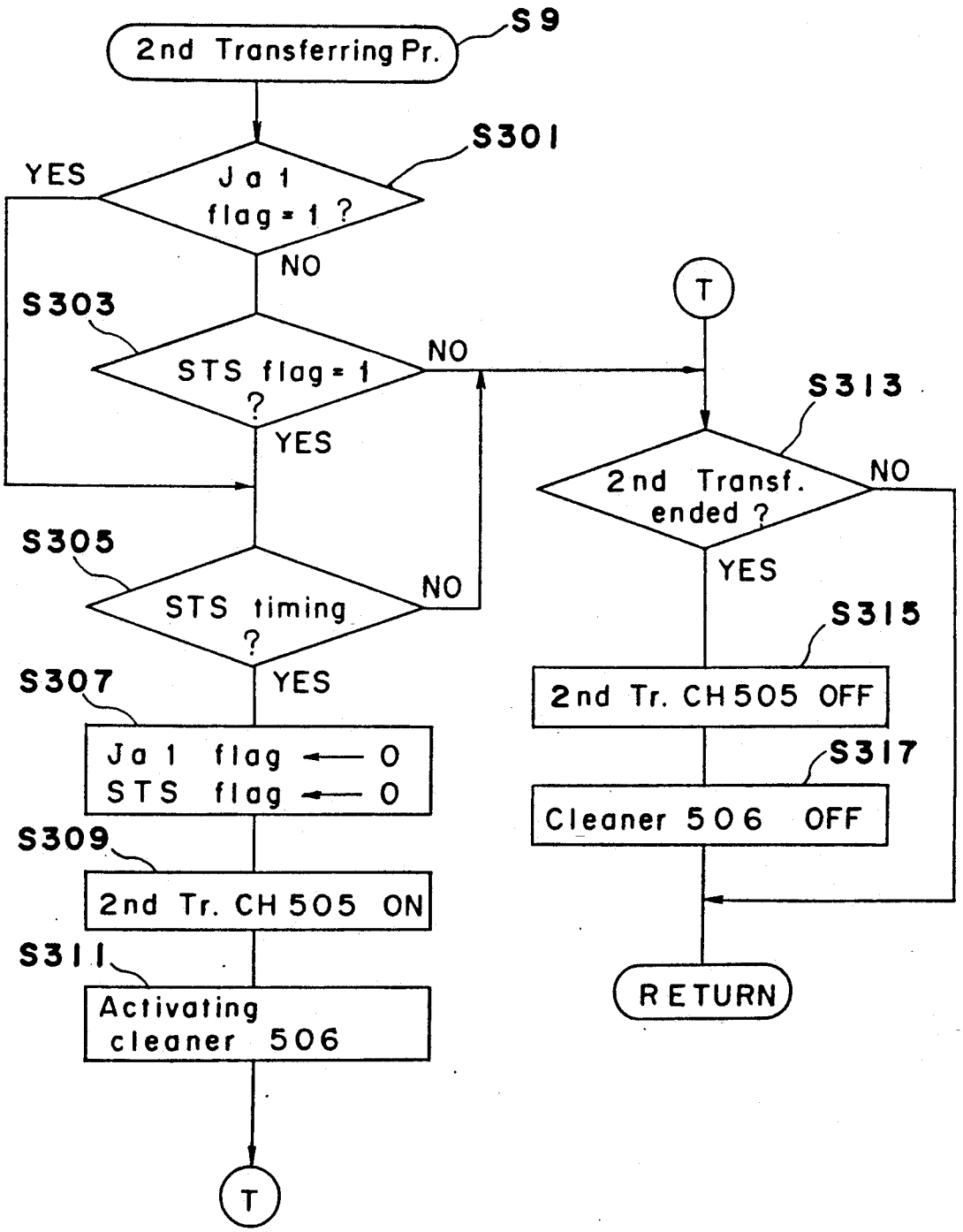
FIG. 9 is a flow chart of the subroutine for a secondary transferring processing shown in FIG. 5.

FIG. 9 shows a flow chart of the subroutine for secondary transferring processing.

In this subroutine, if the Jal flag is set by detecting a paper jam before starting the secondary transferring process or if the secondary transfer starting (STS) flag is set by the completion of the primary transfer, the secondary transferring processing is started at the secondary transfer start timing given by the signal.

Namely, if the Jal flag is set (YES at step S301) or if the secondary transfer starting (STS) flag is set (YES at step S303), the process waits for the signal which gives the secondary transfer start timing at step S305. As stated above, this signal is generated, for example, when the leading edge of the toner image on the intermediate transferring belt 501 reaches the predetermined position.

When the secondary transfer start timing is given at step S305, the Jal flag and the STS flag are reset at step S307. Then, the secondary transferring action is started by switching on the secondary transferring charger 505 at step S309 and the cleaner 506 is activated at step S311.

When the secondary transferring action has been completed at step S318, the secondary transferring charger 505 is turned off at step S315 to finish the secondary transferring action and, then, the cleaner 506 is switched off at step S317.

Thus, the secondary image transferring action is completed.

As is apparent from the above-mentioned, according to the preferred embodiment of the present invention, if a paper jam is caused before starting the secondary image transfer and, accordingly, the intermediate toner image is not damaged thereby, the secondary image transferring action is executed without loss of time just after the copy machine is recovered from the paper jam. Thus, loss of time, waste of toner and electric power are avoided effectively.

It is to be noted that the present invention can be applied to obtain monochromatic hard copies although the method for obtaining full color copies is explained in the present preferred embodiment.

The preferred embodiments described herein are illustrative and not restrictive, the scope of the invention being indicated by the appended claims and all variations which come within the meanings of the claims are intended to be embraced herein.

What is claimed is:

1. An image forming apparatus comprising:

a photoconductive member;

an electrostatic latent image forming means for forming an electrostatic latent image on said photoconductive member according to an original;

a developing means for developing the electrostatic latent image with toner to thereby form a toner image on said photoconductive member;

a toner image retaining member;

a first transfer means for transferring the toner image on said photoconductive member onto said toner image retaining member;

a second transfer means for transferring the toner image on said toner image retaining member onto a paper at a transfer position;

a paper transport means for transporting the paper to which said toner image is to be transferred along a paper transport path to the transfer position;

a jam detection means for detecting an occurrence of a jam of the paper to which said toner image is to be transferred in the paper transport path before the paper reaches the transfer position and before the transfer of the toner image onto the paper has started; and a jam recovery means for activating said paper transport means and said second transfer means immediately when the image forming apparatus is recovered from the paper jam detected by said jam detection means for transferring the toner image on said toner image retaining member at the time that said paper jam was detected onto a paper at the transfer position.

2. An image forming apparatus comprising:

a photoconductive member;

an electrostatic latent image forming means for sequentially forming electrostatic latent image on said photoconductive member according to each of color components of an original;

a developing means for developing said electrostatic latent image with toners of different colors, respectively, to thereby form the corresponding toner image on said photoconductive member;

a toner image retaining member;

a first transfer means for transferring said toner image on said photoconductive member onto said toner image retaining member every time the toner image is formed;

a second transfer means for transferring all of the said toner images on said toner image retaining member onto a paper at a transfer position;

a paper transport means for transporting the paper to which said toner images are to be transferred along a paper transport path to the transfer position so that al of said toner images are transferred on the paper;

a jam detection means for detecting an occurrence of a jam of the paper to which said toner images are to be transferred in the paper transport path before the paper reaches the transfer position and before the transfer of the toner images onto the paper has started; and a jam recovery means for activating said paper transport means and said second transfer means immediately when the image forming apparatus is recovered from the paper jam detected by said jam detection means for transferring the toner images on said toner image retaining member at the time that said paper jam was detected onto a paper at the transfer position.

3. An image forming apparatus as claimed in claim 1, further comprising a cleaning means for removing residual toner from the toner image retaining member after the toner image is transferred to the paper.

4. An image forming apparatus as claimed in claim 3, wherein said cleaning means comprises a blade which is movable between a position to come into contact with the toner image retaining member and a position apart from the toner image retaining member.

5. An image forming apparatus as claimed in claim 2, further comprising a cleaning means for removing residual toner from the toner image retaining member after all of the toner images are transferred to the paper.

6. An image forming apparatus as claimed in claim 5, wherein said cleaning means comprises a blade which is movable between a position to come into contact with the toner image retaining member and a position apart from the toner image retaining member.

* * * * *

UNITED STATES PATENT AND TRADEMARK OFFICE

CERTIFICATE OF CORRECTION

PATENT NO. : 5,117,261

DATED : May 26, 1992

INVENTOR(S) : Toshiyuki Sakai, et al.

It is certified that error appears in the above-identified patent and that said Letters Patent is hereby corrected as shown below:

In col. 2, line 53, change "of" to --to--.

In col. 2, line 55, change "to" to --of--.

In col. 5, line 40, change "to" to --of--.

In col. 11, line 21 (Claim 2, line 4), change "image" to --images--.

In col. 11, line 25 (Claim 2, line 8), change "image" to --images--.

In col. 11, line 27 (Claim 2, line 10), change "image" to --images--.

In col. 11, line 29 (Claim 2, line 12), change "image" to --images--.

In col. 12, line 2 (Claim 2, line 22), change "a1" to --all--.

Signed and Sealed this

Tenth Day of August, 1993

Michael K. Kirk

*Attest:*

MICHAEL K. KIRK

*Attesting Officer*

*Acting Commissioner of Patents and Trademarks*